United States Patent [19]

Fouillet et al.

[11] Patent Number: 4,460,878

[45] Date of Patent: Jul. 17, 1984

[54] TUNABLE RESONATOR AND AN ULTRAHIGH-FREQUENCY CIRCUIT COMPRISING AT LEAST ONE SUCH RESONATOR

[75] Inventors: Jean Fouillet; Jean C. Cruchon, both of Paris, France

[73] Assignee: Thomson-CSF, Paris, France

[21] Appl. No.: 286,973

[22] Filed: Jul. 27, 1981

[30] Foreign Application Priority Data

Jul. 29, 1980 [FR] France ..... 80 16709

[51] Int. Cl.[3] ..... H01P 1/201; H01P 7/04

[52] U.S. Cl. ..... 333/207; 333/226; 333/230

[58] Field of Search ..... 333/219–234, 333/202–212, 263, 245, 248

[56] References Cited

U.S. PATENT DOCUMENTS 3,293,644 12/1966 Loos et al. ..... 333/202

4,207,548 6/1980 Graham et al. ..... 333/226 X

FOREIGN PATENT DOCUMENTS 1061848 7/1951 Fed. Rep. of Germany .

958806 3/1950 France .

1046593 12/1953 France .

1261622 4/1961 France ..... 333/227

1444203 5/1966 France .

575179 4/1976 Switzerland .

*Primary Examiner*—Marvin L. Nussbaum

*Attorney, Agent, or Firm*—Oblon, Fisher, Spivak, McClelland & Maier

[57] ABSTRACT

There is provided a resonator comprising principally a hollow metal finger integral with the wall of a guide or a cavity. A metal plunger, coated with a fine dielectric layer, of fairly low permittivity, is able to slide inside the hollow metal finger to cause the tuning frequency of the cavity or the susceptance coupled to the guide to be varied. This layer may be formed from Teflon.

5 Claims, 2 Drawing Figures

TUNABLE RESONATOR AND AN ULTRAHIGH-FREQUENCY CIRCUIT COMPRISING AT LEAST ONE SUCH RESONATOR

BACKGROUND OF THE INVENTION

The present invention relates to ultrahigh-frequency circuits and more particularly to a tunable resonator usable in such circuits, tunable ultrahigh-frequency filters or ultrahigh-frequency waveguides.

The tunable coaxial resonators used at present for constructing tunable ultrahigh-frequency filters are generally formed by a hollow metal finger forming a clip, fixed with respect to the wall of the filter or of the guide in which it is placed, and a metal finger movable inside this hollow finger, which allows the desired tuning to be obtained.

A number of drawbacks are inherent in this structure. First of all, the contact between the two metal fingers, the clip and the mobile finger, is localized. Now, in resonators intended for example for filters flexible in frequency, i.e. designed for operating over a wide frequency range, the variable tuning obtained by sliding the mobile finger in the clip leads to progressive damage to the contact surfaces so that, after a number of adjustments, the resonator can no longer be used for the quality of the contact has become too poor. In addition, the overvoltage coefficient of such a resonator is not uniform over the whole tuning range. Finally, at the same time as the susceptance of the resonator varies, the electric length of the line varies also.

SUMMARY OF THE INVENTION

The invention has as its object a tunable coaxial resonator usable in tunable circuits, filters or guide susceptances, which does not present the above-mentioned drawbacks.

In accordance with the invention, a tunable resonator comprising a hollow metal finger, fixed with respect to a wall to which it is fixed, and a metal plunger movable inside the hollow finger, is principally characterized in that the hollow finger and the mobile plunger are isolated electrically one from the other by a fine layer of dielectric material forming a sliding layer between the hollow finger and the mobile plunger.

BRIEF DESCRIPTION OF THE DRAWINGS

The invention will be better understood and other characteristics will appear from the following description with reference to the accompanying figures.

DESCRIPTION OF THE PREFERRED EMBODIMENT

Figure 1:
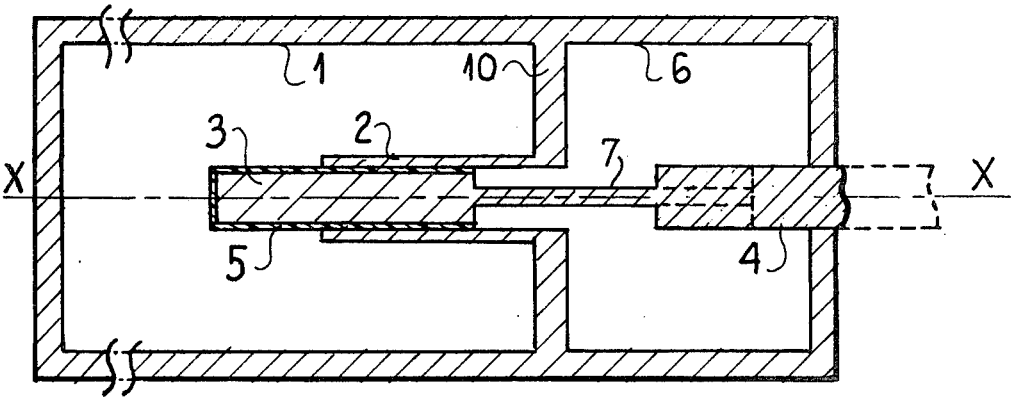
FIG. 1 is the diagram of one embodiment of the tunable coaxial resonator in accordance with the invention.

In FIG. 1 there is shown a resonator, whose structure is that of a re-entrant coaxial cavity, that is to say which comprises a cavity 1 circular or rectangular in section, with axis XX, comprising a re-entrant finger 2 having the same axis as cavity 1.

To obtain tuning, the re-entrant finger length may be modified. For that, a mobile plunger 3 is able to extend the re-entrant finger 2 when it is pushed by means of a pusher 4 sliding in a cavity 6, the re-entrant finger 2 being hollow. This plunger is a metal plunger as well as a pusher 4 which has a thinner part, this pusher 4 being formed integral with the plunger 3. This plunger is a metal plunger, but the sliding of the plunger in the re-entrant finger is ensured by means of an intermediate layer 5 formed from a low-loss dielectric material providing insulation between finger 2 and plunger 3. This intermediate layer 5 is, in the embodiment shown in FIG. 1, a layer which coats the metal plunger 3. This layer may be formed from an organic dielectric material deposited by projection or by a bonded dielectric foil. This layer may also be a bonded paper foil or a simple layer of adhesive. The material chosen for forming the intermediate layer must be able to be deposited in a fine layer adhering to the metal forming the plunger (or the fixed finger) so as to form a layer of 1/100th to 1/10th of a millimeter. Moreover, from the electrical point of view, the material must have a fairly low permittivity ($\epsilon_r$ 4) and only introduce low losses (low tg$\delta$).

In fact, if the permittivity $\epsilon_r$ is too large the length of the line departs from the theoretical length $\lambda/4$ when the position of the plunger is varied, $\lambda$ being the wavelength used, and the TOS of the line then varies with the tuning frequency.

Among the usable materials, there may be mentioned by way of nonlimiting example, polytetrafluorethylene (Teflon), polyester (Mylar type), and epoxy resin, silicone type materials.

The intermediate layer may, instead of covering the plunger, cover the internal wall of the hollow re-entrant finger, by lining.

The role of this intermediate layer is multiple: it prevents the localized metal-metal electric contact existing in prior tunable resonators between the re-entrant finger and the mobile plunger; it substantially increases the overvoltage coefficient Q of the resonator, for the short-circuit at the end of the line is better reduced by this better termination.

This layer may also, by avoiding friction due to the direct mechanical contact between the hollow re-entrant finger and the mobile plunger, substantially increase the service life of circuits using such resonators.

Finally, this layer makes tuning easier to achieve by providing better reproducibility at the contact point, because of the mechanical stability of the device.

This resonator structure enables ultrahigh-frequency filters to be obtained, fixed or tunable in frequency, and TEM-wave-adjustable below cut-off. For example a four-pole filter, formed from four re-entrant coaxial cavities forming series resonators, coupled by means of irises and operating at an average frequency of 2.5 GHz has allowed a variation to be obtained of 30% about the rated frequency for the tuning variation while preserving for the filter good qualities in the whole of this tuning band, and in particular an overvoltage coefficient $Q=3000$ (the band being of 20 MHz at 3 dB).

By way of comparison, a similar filter made with resonators using metal-metal clip contacts only allows an overvoltage coefficient of the order of 1500 to 1600 to be obtained.

The high frequency of the tuning range is obtained when the plunger is flush with the end of the hollow finger and the tuning frequency decreases when the insertion of the plunger into the cavity increases.

Figure 2:
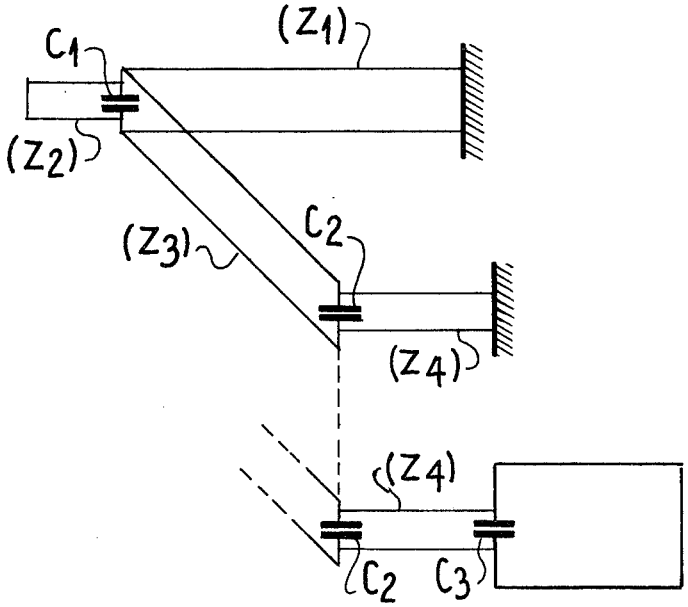
FIG. 2 shows the equivalent electric diagram of the tunable coaxial resonator shown in FIG. 1.

The equivalent electrical diagram of the resonator shown in FIG. 1 is shown in FIG. 2. The cavity 1 and the re-entrant finger 2 form a coaxial line of fixed length, closed by a fixed short-circuit formed by ring 10. This line has an impedance $Z_1$. Cavity 1 and metal plunger 3, in its part extending re-entrant finger 2, form a second coaxial line open at its end of an impedance $Z_2$. Since the length of this extension line is variable, the tuning frequency is variable. The metal plunger 3 forms moreover with re-entrant finger 2, insulated from each other by the intermediate layer 5, a third coaxial line of very low impedance $Z_3$. A capacity $C_1$ due to the discontinuities between these three lines has also been shown in the electric diagram.

The role played by piston 4 provided for adjusting the insertion of the plunger is the following: it forms with the cavity in which it slides a fourth coaxial line of very high impedance $Z_4$; a discontinuity capacity $C_2$ representing the transitition between the third line and this fouth coaxial line. When the part of this piston in mechanical contact with the wall of cavity 6 is also in electric contact with this wall, this line is closed by a short-circuit. It is also possible to extend this line by another open-circuit line of very low impedance $Z_5$, a discontinuity capacity $C_3$ representing the transition between the fourth line and this other line.

The invention is not limited to the embodiments described in connection with the figures. In particular, the resonator has been described in relation with a coaxial cavity of re-entrant structure with the purpose of providing tunable filters. But the same resonator may be used as a variable plunger in a guide for forming a variable susceptance.

What is claimed is:

1. A tunable coaxial resonator comprising:

a metal cavity forming an external conductor and having a re-entrant hollow metal finger fixed with respect to a wall of the cavity to which it is secured, said cavity having a longitudinal axis, an internal conductor in the form of a plunger having the same axis and movable inside a wall of the cavity and the re-entrant hollow finger for extending the length of said re-entrant hollow finger inside said cavity according to a translation movement, the end of the plunger inside said finger having a diameter slightly less than the internal diameter of the finger, said re-entrant hollow finger and said mobile plunger being separated from each other by means of a dielectric layer forming a sliding surface between them, said re-entrant hollow finger and said mobile plunger forming an electrical line of variable length having a very low impedance.

2. The resonator as claimed in claim 1, wherein said dielectric material layer covers the mobile plunger.

3. The resonator as claimed in claim 1, wherein said dielectric material layer covers the internal wall of the hollow metal finger.

4. An ultrahigh-frequency circuit comprising, for forming a tunable ultrahigh-frequency filter, at least one tunable resonator in accordance with claim 1, wherein:

said tunable ultrahigh-frequency filter formed from several cavities, each cavity forms with an associated tunable resonator a cavity of re-entrant coaxial structure.

5. An ultrahigh-frequency circuit comprising an ultrahigh-frequency guide to the wall of which is fixed at least one tunable resonator as claimed in claim 1 forming in said guide a variable susceptance.

* * * * *